US008244158B2

(12) United States Patent
Miwa

(10) Patent No.: US 8,244,158 B2
(45) Date of Patent: Aug. 14, 2012

(54) IMAGE FORMING APPARATUS

(75) Inventor: Atsushi Miwa, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 309 days.

(21) Appl. No.: 12/732,397

(22) Filed: Mar. 26, 2010

(65) Prior Publication Data

US 2010/0303502 A1 Dec. 2, 2010

(30) Foreign Application Priority Data

May 29, 2009 (JP) ..... 2009-130048

(51) Int. Cl.
*G03G 15/00* (2006.01)

(52) U.S. Cl. ..... 399/167; 399/364

(58) Field of Classification Search ..... 399/167, 399/364

See application file for complete search history.

(56) References Cited

U.S. PATENT DOCUMENTS

| | | | |
|---|---|---|---|
| 5,642,200 | A | 6/1997 | Kurihara et al. |
| 2003/0063936 | A1 | 4/2003 | Sasaki et al. |

FOREIGN PATENT DOCUMENTS

| | | | |
|---|---|---|---|
| JP | H08-188318 | A | 7/1996 |
| JP | H08-231133 | A | 9/1996 |
| JP | 11-165915 | | 6/1999 |
| JP | 2002-003048 | | 1/2002 |
| JP | 2003-104613 | A | 4/2003 |
| JP | 2005-265936 | A | 9/2005 |
| JP | 2006-021904 | A | 1/2006 |

OTHER PUBLICATIONS

Japanese Decision of Patent Grant dated Apr. 26, 2011 together with an English language translation from JP 2009-130048.

*Primary Examiner* — David Gray
*Assistant Examiner* — Erika J Villaluna
(74) *Attorney, Agent, or Firm* — Scully, Scott, Murphy & Presser, P.C.

(57) ABSTRACT

An apparatus includes: an image forming unit having a photosensitive drum; a motor configured to rotate forwardly and reversely; a discharging roller to which a driving force is transferred from the motor; an one way clutch configured to transfer the driving force to the photosensitive drum or block a transfer of the driving force; a returning roller returning the recording sheet drawn by the discharging roller; a rotation direction converting mechanism transmitting the driving force to the returning roller to rotate the returning roller in a certain direction; and a time lag mechanism including engaging portions with a gap therebetween, when the rotation direction of the motor being switched, each of the engaging portions being engaged with each other after a predetermined time, thereby delaying the transfer of the driving force from the motor to the returning roller.

7 Claims, 12 Drawing Sheets

IMAGE FORMING APPARATUS

CROSS REFERENCE TO RELATED APPLICATION

The present application claims priority from Japanese Patent Application No. 2009-130048, which was filed on May 29, 2009, the disclosure of which is herein incorporated by reference in its entirety.

TECHNICAL FIELD

The apparatuses and devices consistent with the present invention relate to an image forming apparatus capable of performing double-sided printing.

BACKGROUND

There is a related art image forming apparatus which includes a photosensitive drum for forming an image on a paper, a discharging roller for discharging the paper with the image formed thereon to a paper discharging tray, and a returning roller for returning the paper, which has been returned into the apparatus main body by a reverse rotation of the discharging roller, to an upstream side in a paper transport direction of the photosensitive drum. Specifically, the image forming apparatus includes a first motor for driving the photosensitive drum and the returning roller, and a second motor for driving the discharging roller. When single-sided printing is performed, the image forming apparatus forwardly rotates the first motor and the second motor simultaneously so as to transport the paper in the order of the photosensitive drum and the discharging roller.

In addition, in a case where double-sided printing is performed, after single-sided printing has been performed as described above, only the second motor is caused to reversely rotate, before the paper is completely separated from the discharging roller, so that the paper is returned into the apparatus main body. The paper returned into the apparatus main body is returned to the upstream side in the paper transport direction of the photosensitive drum by the returning roller and the photosensitive drum, which are driven by the forwardly rotating first motor, and thereafter reverse-side printing is performed.

SUMMARY

Recently, it has been desired that the two motors described above are not installed but the discharging roller and the photosensitive drum are driven only by one motor. In this case, however, when the discharging roller is reversely rotated, the photosensitive drum and the returning roller also reversely rotate together.

In order to solve the problem, an apparatus includes a clutch for switching the transmitting and the blocking of the driving force from the motor to the photosensitive drum or a rotation direction converting mechanism for keeping the returning roller under forward rotation regardless of the rotation direction of the motor. According to this structure, in case of single-sided printing, the motor is forwardly rotated to transport the paper in the order of the photosensitive drum and the discharging roller, thereby performing printing on one side of the paper.

In addition, in case of the double-sided printing, after the printing on one side of the paper is performed as described above, when the motor is reversely rotated before the paper is completely separated from the discharging roller, a clutch is released so as to stop the rotation of the photosensitive drum, and the returning roller remains forwardly rotated by the switching of the rotation direction converting mechanism. Furthermore, after the paper, which has been passed from the discharging roller to the returning roller, is removed from the discharging roller, the motor is returned to the forward rotation. At this time, the clutch and the rotation direction converting mechanism are controlled so as to forwardly rotate the photosensitive drum and the returning roller.

In addition, the photosensitive drum is charged from a time when the photosensitive drum forwardly rotates so as to start the preparation of the image forming. In this case, however, if the return path (a path through which the paper, which has been returned from the discharging roller into the apparatus main body, passes toward the photosensitive drum) is shortened for realizing the compactness of the apparatus, before the overall circumference of the photosensitive drum is charged, the paper reaches the photosensitive drum, which causes deterioration of the image quality.

Thus, an object of the invention is to provide an image forming apparatus that is capable of satisfactorily performing double-sided printing even when the return path is shortened.

According to an illustrative aspect of the present invention, there is provided an image forming apparatus comprising: an image forming unit that includes a photosensitive drum for carrying a developer image, the image forming unit configured to form an image on a recording sheet by transferring the developer image of the photosensitive drum onto the recording sheet; a motor that is configured to rotate forwardly and reversely; a discharging roller to which a driving force is transferred from the motor, the discharging roller configured to discharge the recording sheet outside of an apparatus main body when the motor rotates forwardly, the discharging roller configured to draw the recording sheet into the apparatus main body when the motor rotates reversely; an one way clutch that transfers the driving force from the motor to the photosensitive drum when the motor rotates forwardly, the one way clutch blocking a transfer of the driving force from the motor to the photosensitive drum when the motor rotates reversely; a returning roller that returns the recording sheet drawn by the discharging roller to the image forming unit; a rotation direction converting mechanism that transmits the driving force from the motor to the returning roller so as to rotate the returning roller in a certain direction regardless of a rotation direction of the motor; and a time lag mechanism that includes a pair of engaging portions disposed with a gap therebetween, when the rotation direction of the motor being switched, each of the engaging portions being engaged with each other after a predetermined time, thereby delaying the transfer of the driving force from the motor to the returning roller.

According to the present invention, when a paper, which has been passed from a discharging roller to a returning roller by a reverse rotation of a motor, is removed from the discharging roller, if the motor is switched to a forward rotation the transfer of the driving force from the motor to the returning roller is delayed by a time lag mechanism. That is, since after the motor is switched to a forward rotation, the returning roller can be stopped for a certain time, the overall circumference of the photosensitive drum which rotates forwardly almost at the same time with the switching to the forward rotation of the motor can be charged, and then a recording sheet can be rushed into the photosensitive drum.

According to the invention, the returning roller can be stopped for a certain time, so that it is possible to satisfactorily perform double-sided printing even when the return path is short.

BRIEF DESCRIPTION OF THE DRAWINGS

Illustrative aspects of the invention will be described in detail with reference to the following figures wherein:

FIG. 11A is a plan view showing the state at the time of the forward rotation, and FIG. 11B is a plan view showing the state at the time of the reverse rotation; FIG. 12A is a plan view showing the state at the time of the forward rotation, and FIG. 12B is a plan view showing the state at the time of the reverse rotation.

DETAILED DESCRIPTION OF EXEMPLARY EMBODIMENTS OF THE PRESENT INVENTION

Overall Structure of Laser Printer

First of all, the overall structure of a laser printer as one example of an image forming apparatus of the present invention will be simply described. In addition, in the following description, the front and the rear and up and down are based on the directions indicated in FIG. 1.

Figure 1:
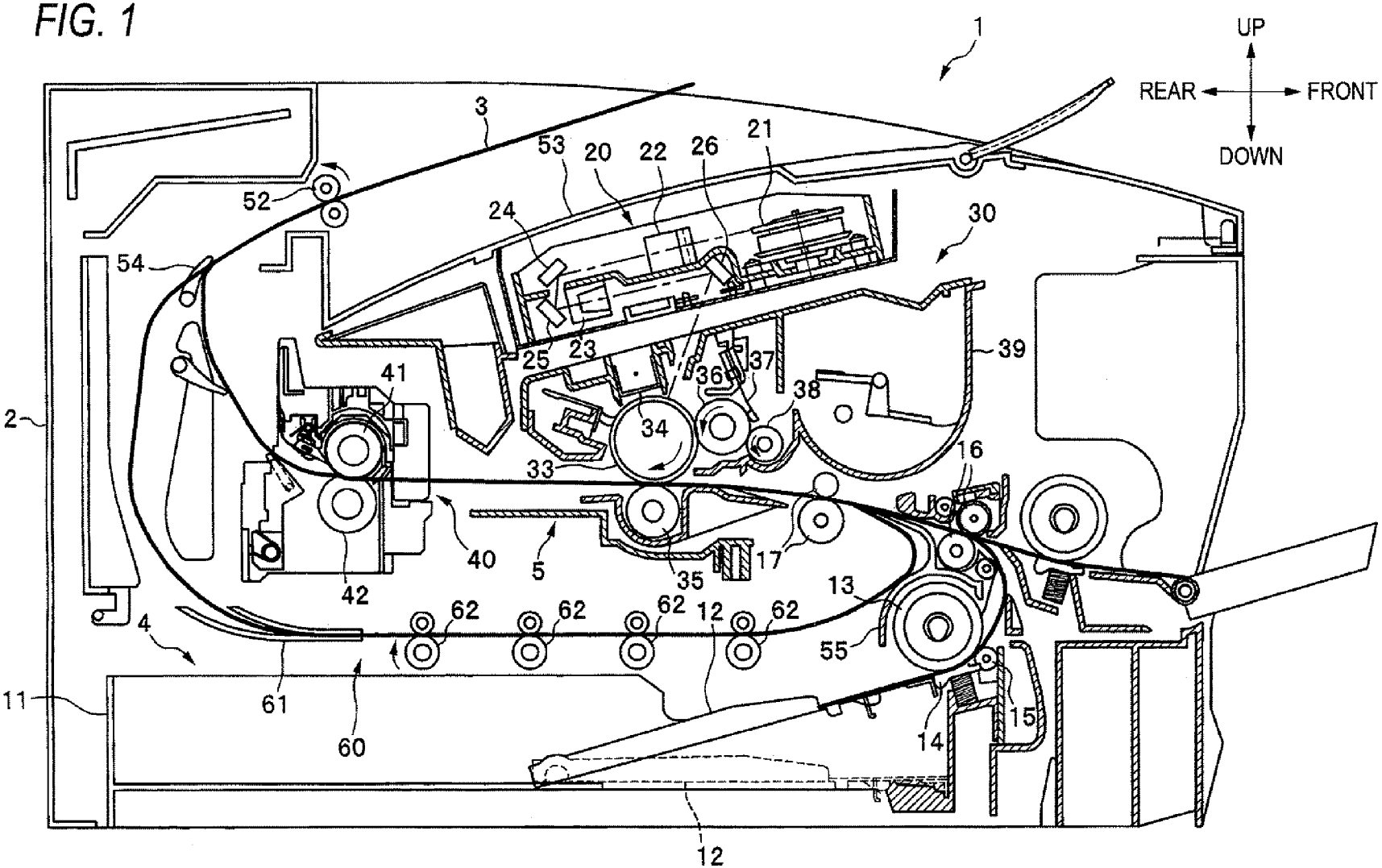
FIG. 1 is a side sectional view that shows one embodiment of a laser printer as one example of an image forming apparatus of the present invention.

As shown in FIG. 1, a laser printer 1 includes a feeder portion 4 for feeding papers 3 into an apparatus main body 2, and an image forming unit 5 for forming an image on the fed paper 3.

The feeder portion 4 includes a paper feeding tray 11 that is removably mounted on a bottom portion in the apparatus main body 2, and a paper pressuring plate 12 installed in the paper feeding tray 11. In addition, the feeder portion 4 includes a paper feeding roller 13 and a paper feeding pat 14 which are installed on the upper side of one end side of the paper feeding tray 11, and paper gripping rollers 15 and 16 which are installed downstream in the transport direction of the papers 3 relative to the paper feeding roller 13. In addition, the feeder portion 4 includes a resist roller 17 which is installed downstream relative to the paper gripping rollers 15 and 16.

In addition, in the feeder portion 4, the papers 3 in the paper feeding tray 11 are moved toward the paper feeding roller 13 by means of the paper pressing plate 12 and delivered to the paper feeding roller 13 and the paper feeding pat 14 so as to be transported to an image forming unit 5 one by one after the papers 3 have passed through each driven rollers 13 to 16.

The image forming unit 5 includes a scanner portion 20, a process cartridge 30, and a fixing device 40.

The scanner portion 20 is installed at the upper portion in the apparatus main body 2 and includes a laser emitting portion (not shown), a polygon mirror 21 which is rotatably driven, lenses 22 and 23, and reflective mirrors 24, 25 and 26 or the like. In addition, in the scanner portion 20, a laser beam passes through a path shown by a chained line in the drawing and is illuminated by being high-speed scanned onto a surface of a photosensitive drum 33 as one example of a photosensitive drum in the process cartridge 30.

The process cartridge 30 is configured such that it is disposed at the lower portion of the scanner portion 20 and is removably mounted relative to the apparatus main body 2. In addition, the process cartridge 30 includes a photosensitive drum 33, a scorotron-type charger 34, a transfer roller 35, a development roller 36, a layer thickness restricting blade 37, a supplying roller 38, and a toner hopper 39.

In the process cartridge 30, the surface of the photosensitive drum 33 that has been charged by the scorotron-type charger 34 is exposed with the laser beam from the scanner portion 20, thereby forming an electromagnetic latent image on the photosensitive drum 33. This electromagnetic latent image is supplied with a toner as one example of a developing agent in the toner hopper 39 via a supplying roller 38 and a development roller 36, thereby forming a toner image (developing agent image) on the photosensitive drum 33. Thereafter, when the papers 3 are transported between the photosensitive drum 33 and the transfer roller 35, the toner image carried on the photosensitive drum 33 is transferred to the papers 3, thereby forming images on the papers 3.

The fixing device 40 is a device for heat-fixing the toner image transferred to the papers 3 and includes a heating roller 41 disposed downstream of the process cartridge 30 and a pressure roller 42 which is disposed opposite to the heating roller 41 so as to pressurize the heating roller 41.

In addition, the papers 3, which have been heat-fixed by the fixing device 40, are discharged to a paper discharging tray 53 outside of the apparatus main body 2 by means of the forwardly rotating discharging roller 52.

Furthermore, at the time of the double-sided printing, the discharging roller 52 reversely rotates before it discharges all of the papers 3 onto the paper discharging tray 53, thereby returning the papers 3 into the apparatus main body 2. The papers 3 returned into the apparatus main body 2 pass through the rear side of the fixing device 40 by means of the switch of a flapper 54 and are thereafter transported to a double-sided transport path unit 60.

The double-sided transport path unit 60 is a device for performing the double-sided transport and is disposed between the fixing device 40 and the process cartridge 30, and the paper feeding tray 11. Herein, "double-sided transport" refers to transportation performed for returning the papers 3 to the upstream side of the process cartridge 30 in a state in which the surfaces and the backs thereof are reversed in order to print the back sides of the papers 3 of which the surfaces are printed.

The double-sided transport path unit 60 includes a guide member 61 and a plurality of pairs of returning roller 62. The guide member 61 switches the direction of the paper 3, which are transported downward through the rear of the fixing device 40, to the front direction. The plurality of pairs of returning rollers 62 return the papers 3, which have been guided by a guide member 61, to the upstream side of the photosensitive drum 33, and are arranged one after another. In addition, the papers 3 discharged from the double-sided transport path unit 60 are guided toward the resist roller 17 with the surface and the back being reversed, by means of a guide 55 placed ahead of the double-sided transport path unit 60. After the front ends of the papers 3 have been aligned by means of the resist roller 17, the toner image of the photosensitive drum 33 is hereby transferred onto the back sides of the papers 3.

Driving Mechanism

Next, with reference to FIGS. 2 to 4, a driving mechanism 70 for rotating the photosensitive drum 33, the discharging roller 52 and the returning roller 62 described above will be described.

Figure 2:
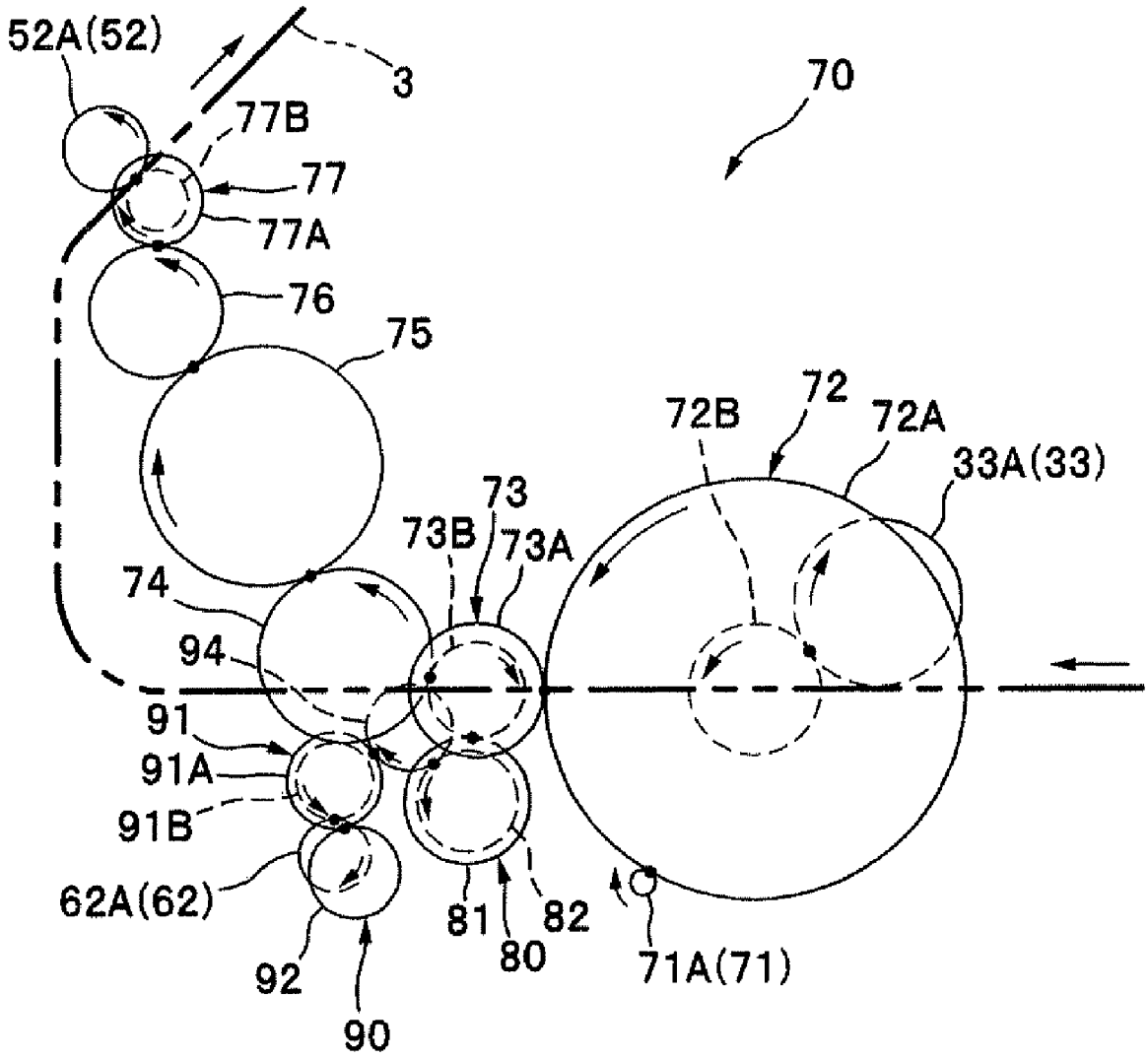
FIG. 2 is a diagram showing a driving mechanism in a simplified manner.
Figure 3:
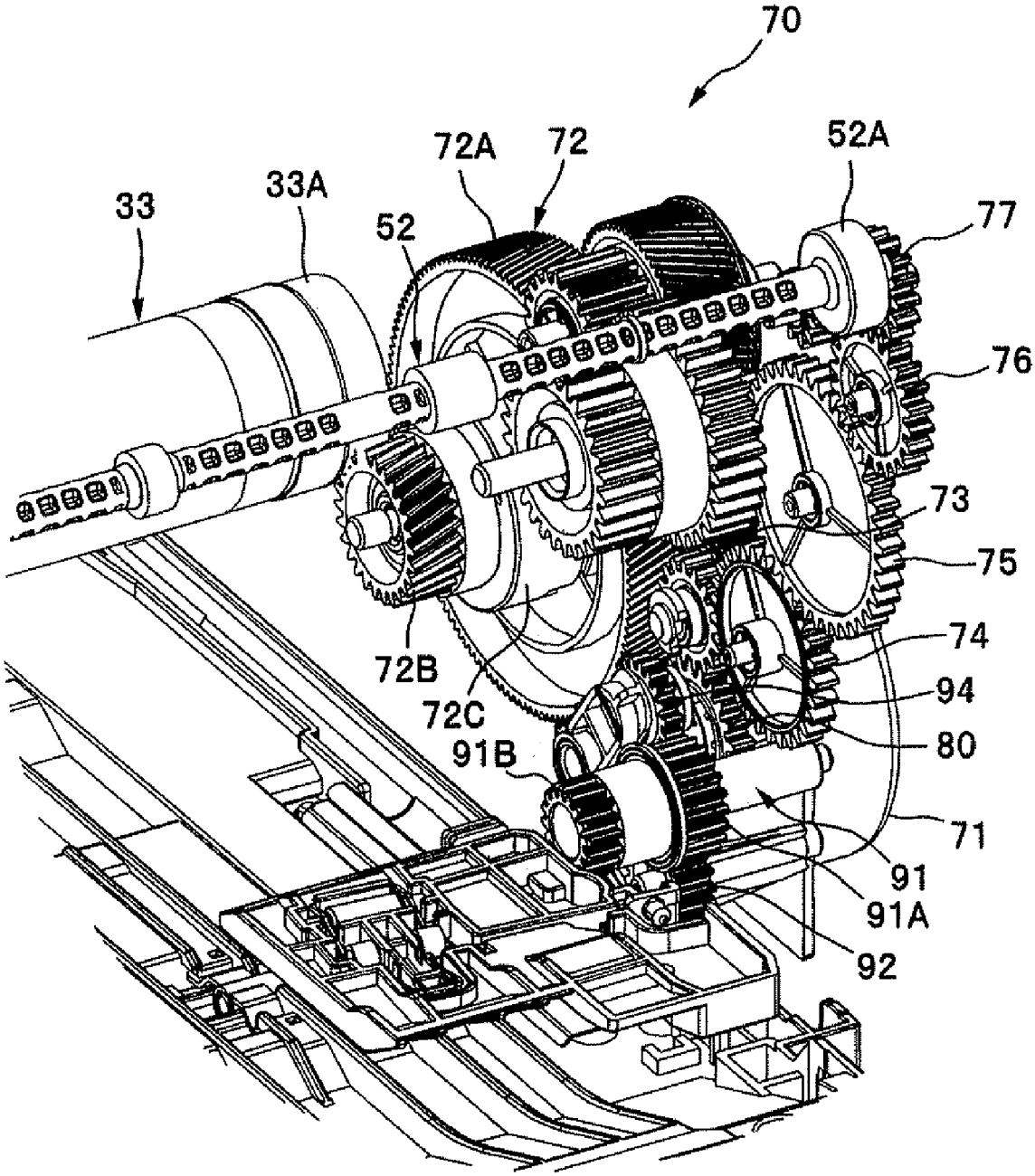
FIG. 3 is a perspective view in which the driving mechanism is viewed from an inner side of an apparatus main body.

As shown in FIG. 2, the driving mechanism 70 includes a motor 71 capable of forwardly rotating and reversely rotating, an one-way clutch 72 for transmitting the driving force of the motor 71 to the photosensitive drum 33, a plurality of gears 73 to 77 for transmitting the driving force of the motor 71 to the discharging roller 52, a time lag mechanism 80 for transmitting the driving force of the motor 71 to the returning roller 62, and a rotation direction converting mechanism 90.

Furthermore, in FIG. 2, each of the gears is shown by a pitch circle, and in order to facilitate the understanding of the engaging appearance of each gear, the portions in which gear teeth are engaged with each other are indicated by dots.

The one-way clutch 72 includes a large diameter gear portion 72A which is engaged with gear teeth formed on a driving shaft 71A of the motor 71, and a small diameter gear portion 72B which is engaged with a drum driving gear 33A formed coaxially and integrally with the end of the photosensitive drum 33. In addition, as shown in FIG. 3, the large diameter gear portion 72A and the small diameter gear portion 72B are disposed so as to be separated from each other in the axial direction and a clutch mechanism 72C is installed therebetween.

The clutch mechanism 72C acts so as to transfer the driving force from the motor 71 to the photosensitive drum 33 at the time of the forward rotation of the motor 71 (rotation direction of FIG. 2) and block the transfer of the driving force from the motor 71 to the photosensitive drum 33 at the time of the reverse rotation of the motor 71. Furthermore, as the clutch mechanism 72C, mechanisms can be adopted. For example, a mechanism can be adopted in which both ends of the coil spring are fixed to the large diameter gear portion 72A and the small diameter gear portion 72B, when the large diameter gear portion 72A rotates forwardly, the coil spring is wound so as to be tightened, thereby transmitting the driving force from the large diameter gear portion 72A to the small diameter gear portion 72B, and when the large diameter gear portion 72A rotates reversely, the coil spring is released, thereby not transmitting the driving force from the large diameter gear portion 72A to the small diameter gear portion 72B.

As shown in FIG. 2, the gear 73 is a two-stage gear, and a large diameter gear portion 73A thereof is engaged with the large diameter gear portion 72A of the one way clutch mechanism 72, thereby the driving force from the one way clutch mechanism 72 is transferred thereto. Herein, the large diameter gear portion 72A of the one way clutch mechanism 72 forwardly rotates and reversely rotates according to the forward rotation and the reverse rotation of the motor 71, so that the gear 73 is also capable of forwardly rotating and reversely rotating.

A small diameter gear portion 73B of the gear 73 is connected to a discharging gear 52A that is installed coaxially and integrally with the end of the discharging roller 52 via the gears 74, 75, 76 and 77, and is connected to a returning gear 62A via the time lag mechanism 80 and the rotation direction converting mechanism 90. In addition, the returning gear 62A transfers the driving force to each returning roller 62 via a gear which is not shown.

Figure 4:
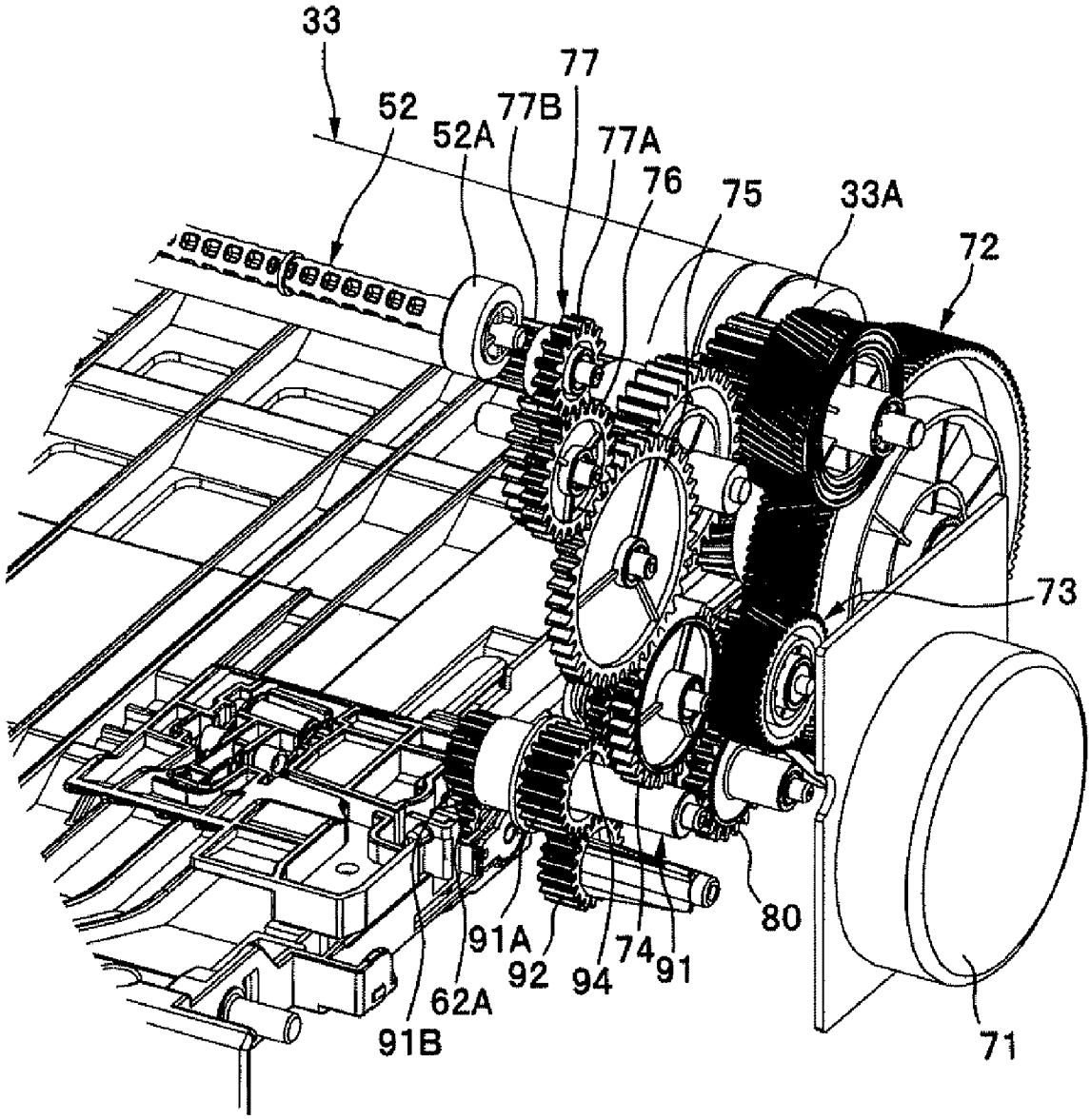
FIG. 4 is a perspective view in which the driving mechanism is viewed from an outer side of the apparatus main body.

In addition, as shown in FIG. 4, the gear 77 is a two-stage gear, a large diameter gear portion 77A thereof is engaged with a gear 76 at the upstream side in the driving force transmitting direction and a small diameter gear portion 77B thereof is the discharging gear 52A.

Figure 5A:
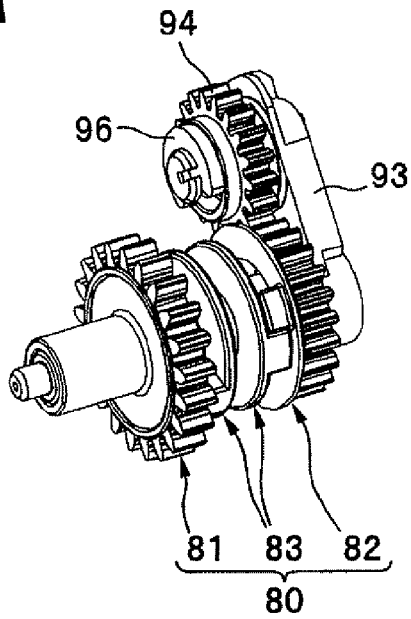
FIG. 5A is a perspective view in which a structure around a time lag mechanism is viewed from the input gear side.
Figure 5B:
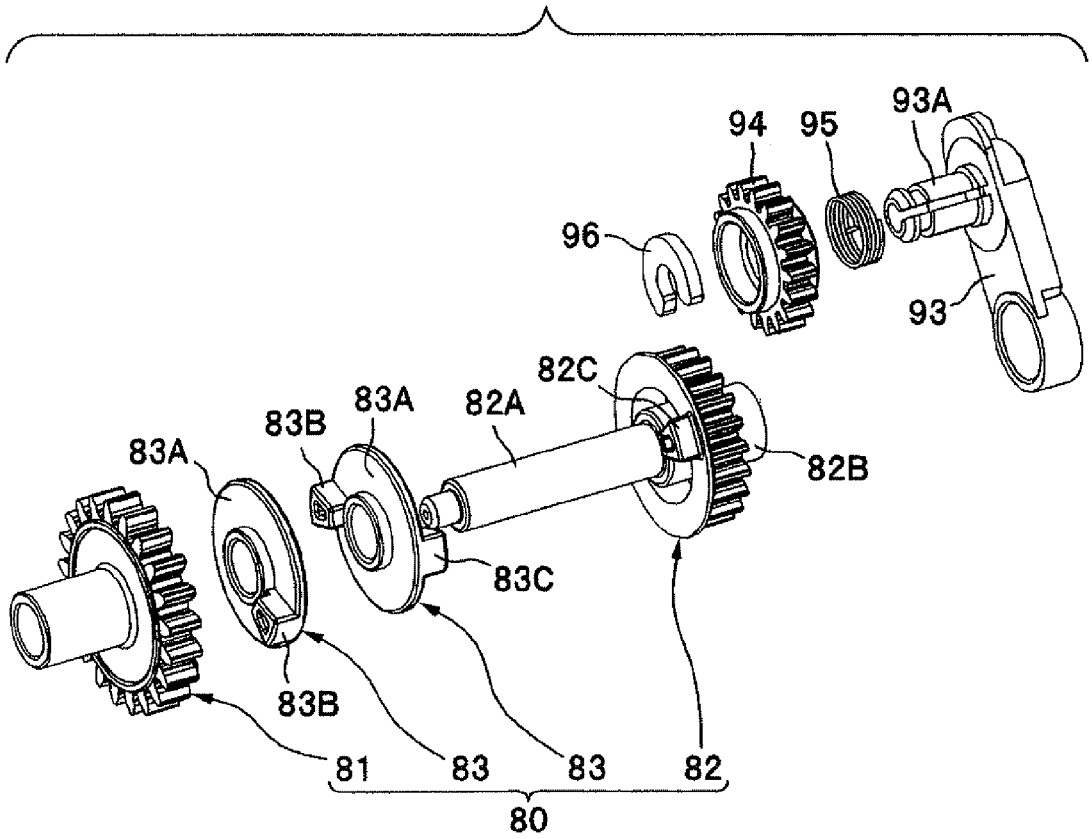
FIG. 5B is an exploded perspective view.

As shown in FIGS. 5A and 5B, the time lag mechanism 80 includes an input gear 81 disposed at the motor 71 side, an output gear 82 disposed at the returning roller 62 side, and two lag members 83 disposed between the input gear 81 and the output gear 82.

Figure 6:
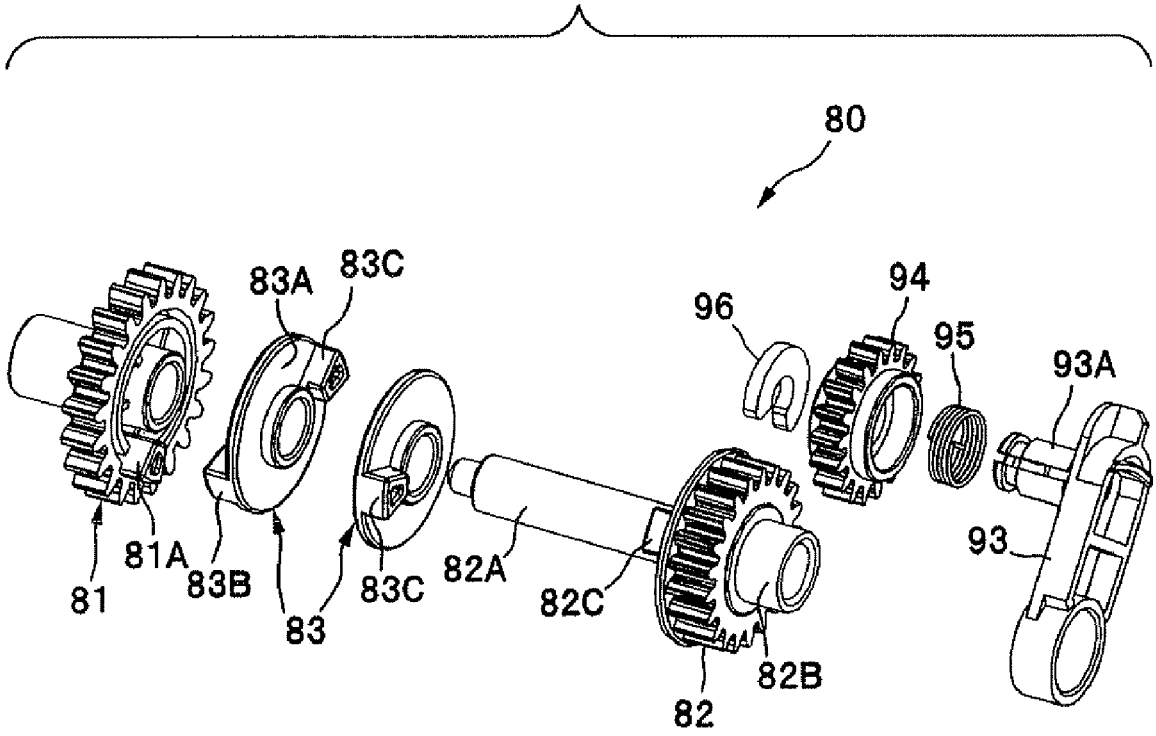
FIG. 6 is an exploded perspective view in which the structure around the time lag mechanism is viewed from the output gear side.

As shown in FIGS. 5 and 6, the input gear 81 is rotatably supported relative to a first shaft portion 82A of the output gear 82 and is disposed coaxially with the output gear 82. In addition, on the surface of the input gear 81 facing the output gear 82, an input side protrusion 81A as one example of an engaging portion, which is protruded from the input gear 81 toward the output gear 82, is formed at a position deviated from the rotation center portion.

The output gear 82 includes a first shaft portion 82A protruded from the rotation center portion toward the input gear 81, a second shaft portion 82B protruded from the rotation center portion toward the opposite side of the input gear 81, and an output side protrusion 82C as one example of the engaging portion. The output side protrusion 82C protrudes from a position (specifically, the same position as the input side protrusion 81A in the diameter direction), which is different from the rotation center portion among the surfaces of the input gear 81 side, toward the input gear 81.

Two lag members 83 are disposed coaxially with each other between the input gear 81 and the output gear 82 and are rotatably supported on the first shaft portion 82A of the output gear 82. Each of the time lag members 83 is formed in a dot symmetrical shape, and mainly includes a main body portion 83A having a circular plate shape, a first protrusion 83B protruded from the main body portion 83A toward the input gear 81, and a second protrusion 83C protruded from the main body portion 83A toward the output gear 82.

In addition, the first protrusion 83B of one (facing the input gear 81) of the two lag members 83 is engaged with the input side protrusion 81A of the input gear 81 in the circumferential direction, and the second protrusion 83C is engaged with the first protrusion 83B of another time lag member 83 in the circumferential direction.

In other words, the second protrusion 83C of one time lag member 83 is engaged with the output protrusion 82C of the output gear 82 in the circumferential direction via another time lag member 83. Furthermore, the first protrusion 83B of another time lag member 83 is engaged with the input side protrusion 81A of the input gear 81 in the circumferential direction via one time lag member 83, and the second protrusion 83C is engaged with the output side protrusion 82C of the output gear 82 in the circumferential direction.

In the time lag mechanism 80 structured as above, the input side protrusion 81A of the input gear 81 and output side protrusion 82C of the output gear 82 is disposed with a gap therebetween in the circumferential direction, and two lag members 83 are inserted between the input side protrusion 81A and the output side protrusion 82C. Thus, the above-described gap is substantially extended. That is, in a case where two lag members 83 are not installed, the circumferential gap between the input side protrusion 81A and the output side protrusion 82C is a distance which does not reach one circumference even at maximum, but by providing two lag members 83, the gap is extended up to a distance equal to or larger than substantially one circumference.

In addition, the time lag mechanism 80, when the rotation direction of the motor 71 is switched, the input side protrusion 81A and the output side protrusion 82C are engaged with each other via two lag members 83 after a predetermined time, thereby delaying the transfer of the driving force from the motor 71 to the returning roller 62. Specifically, when the input gear 81, each time lag member 83 and the output gear 82 are engaged with each other so as to be integrally rotated, if the rotation direction of the motor 71 is switched, first of all, the input side protrusion 81A is increasingly separated from the first protrusion 83B of one time lag member 83. At this time, only the input gear 81 is rotated and each time lag member 83 and the output gear 82 are being stopped.

Thereafter, when the input side protrusion 81A is engaged with the first protrusion 83B of one time lag member 83, the input gear 81 and one time lag member 83 begin to rotate integrally, and the second protrusion 83C of one time lag member 83 is increasingly separated from the first protrusion 83B of another time lag member 83. At this time, the input gear 81 and one time lag member 83 are only integrally rotated, and another time lag member 83 and the output gear 82 are being stopped.

Thereafter, when the second protrusion 83C of one time lag member 83 is engaged with the first protrusion 83B of another time lag member 83, the input gear 81 and two lag members 83 begin to integrally rotate, and the second protrusion 83C of another time lag member 83 is increasingly separated from the output side protrusion 82C. At this time, input gear 81 and two lag members 83 are only integrally rotated and the output gear 82 is being stopped.

Finally, when the second protrusion 83C of another time lag member 83 is engaged with output side protrusion 82C, all of the input gear 81, two lag members 83 and the output gear 82 begin to rotate and the transfer of the driving force toward the returning roller 62 is started.

Figure 7A:
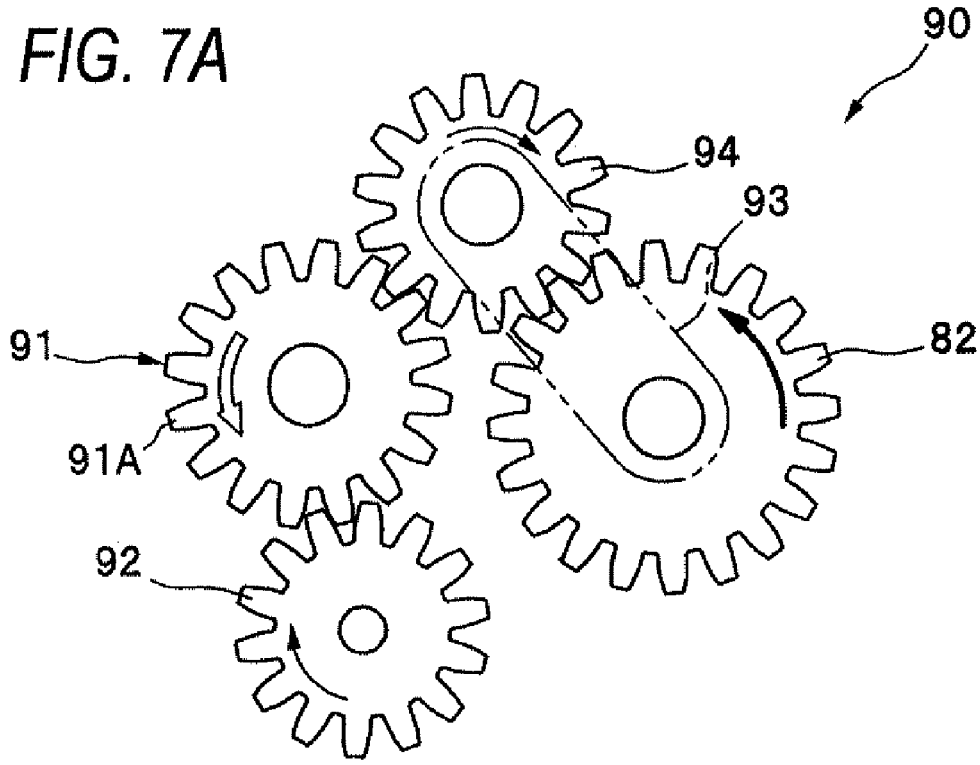
FIG. 7A is a plan view showing a state when the rotation direction converting mechanism rotates forwardly.

As shown in FIG. 7A, a rotation direction converting mechanism 90 shares the output gear 82 of the above-described time lag mechanism 80 as one example of the upstream side gear disposed at the motor 71 side and includes a downstream side gear 91, a rotation direction converting gear 92, an oscillating arm 93, and a planetary gear 94.

The downstream side gear 91 is a two-stage gear disposed at the returning roller 62, and as shown in FIG. 2, has a large diameter gear portion 91A which is engaged with the planetary gear 94 and the rotation direction converting gear 92, and a small diameter gear portion 91B which is engaged with the returning gear 62A. In addition, for convenience, the small diameter gear portion 91B of the downstream side gear 91 is omitted from FIG. 7.

As shown in FIG. 7A, the rotation direction converting gear 92 is disposed at the lower side of the downstream side gear 91 and is always engaged with the downstream side gear 91.

As shown in FIGS. 5 and 6, the proximal end of the oscillating arm 93 is supported on the second shaft portion 82B of the output gear 82 so as to be able to oscillate, and at the front end of the oscillating arm 93, there is installed a shaft portion 93A which is protruded toward the output gear 82 along the axial direction of the output gear 82.

The planetary gear 94 is a gear which can be engaged with one of the downstream side gear 91 and the rotation direction converting gear 92 (see FIG. 7) and is rotatably supported on the shaft portion 93A of the oscillating arm 93. In addition, the coil spring 95 is inserted between the planetary gear 94 and the oscillating arm 93 in a shrunk state, and the planetary gear 94 is installed at the shaft portion 93A by means of an anti-loosing member 96. Thus, unless the frictional force of the planetary gear 94 and the coil spring 95 is overcome, the planetary gear 94 is not rotated (revolved) relative to the oscillating arm 93.

That is, for example, under the state of FIG. 7A, when the output gear 82 forwardly rotates (rotates in a counterclockwise direction as shown), the oscillation of the oscillating arm 93 is stopped by the engagement of the downstream side gear 91 with the planetary gear 94. Thus, the planetary gear 94 to which the driving force has been transferred from the output gear 82 overcomes the frictional force with the coil spring 95 and revolves on the spot. The downstream side gear 91 hereby rotates in the counterclockwise direction as shown.

Figure 7B:
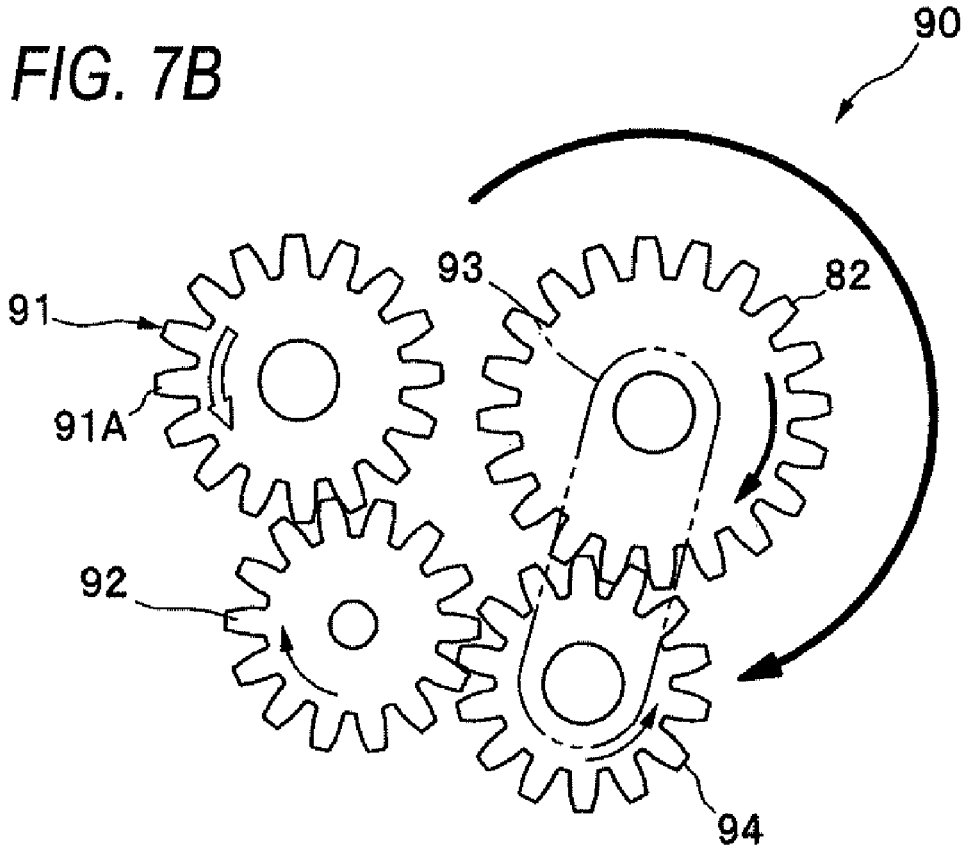
FIG. 7B is a plan view showing a state when a rotation direction converting mechanism rotates reversely.

Furthermore, in a case where the output gear 82 is caused to reversely rotate (rotate in a clockwise direction as shown) from the state of FIG. 7A, as shown in FIG. 7B, since there is no hindrance to the oscillation in the clockwise direction of the oscillating arm 93, the oscillating arm 93 becomes freely oscillating before the planetary gear 94 rotates relative to the oscillating arm 93 (coil spring 95). The planetary gear 94 hereby moves around the output gear 82 (revolves about the output gear 82).

Figure 8:
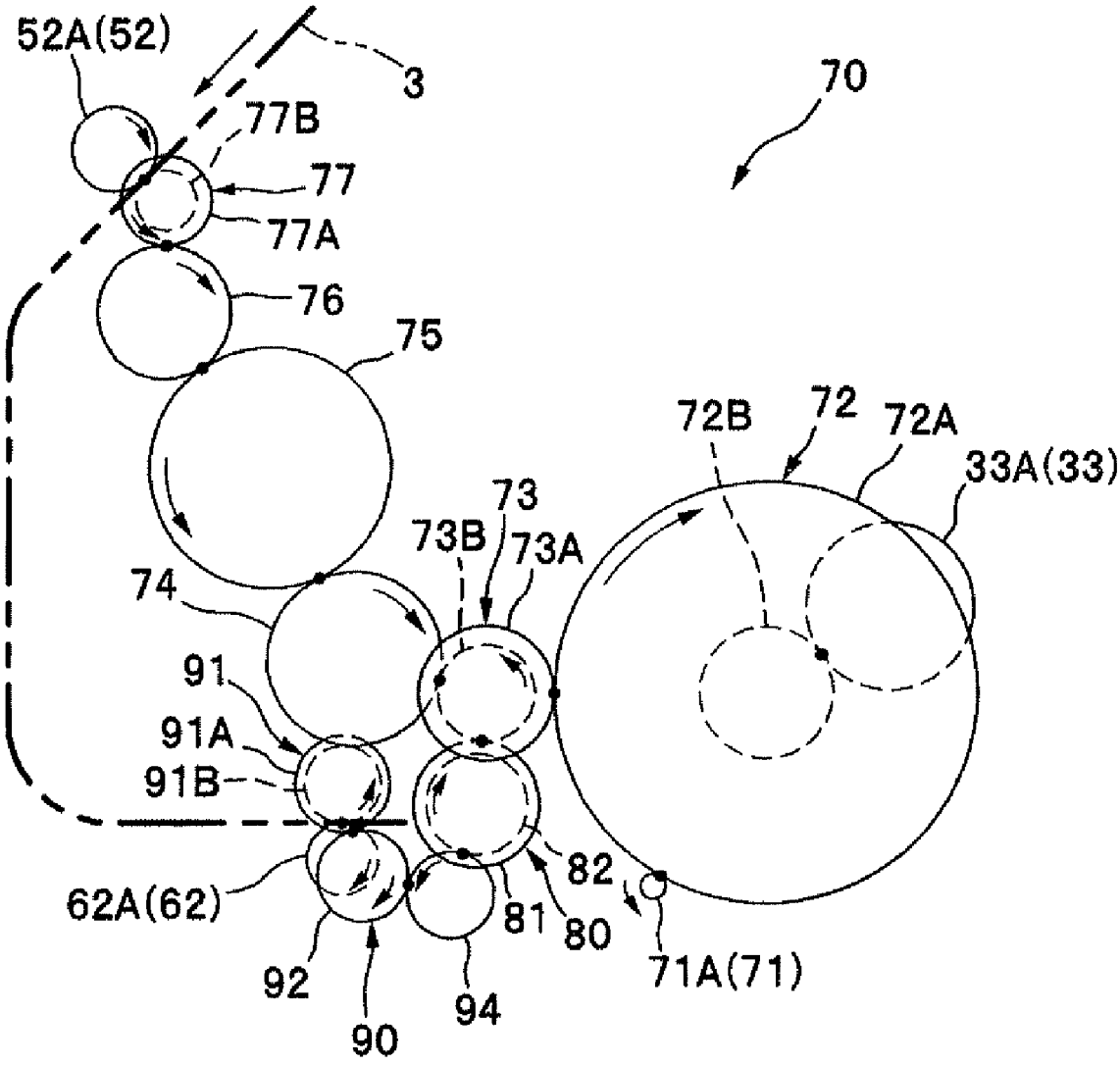
FIG. 8 is a diagram simply showing a state in which the driving mechanism reversely rotates.

In addition, when the revolving planetary gear 94 is engaged with the rotation direction converting gear 92, the oscillation of the oscillating arm 93 can be stopped. Thus, the planetary gear 94 to which the driving force has been transferred from the output gear 82 overcomes the frictional force with the coil spring 95 and revolves on the spot. At this time, one rotation direction converting gear 92 is inserted between the planetary gear 94 and the downstream side gear 91, so that the downstream side gear 91 rotates in the same direction (counterclockwise direction as shown) as at the time of the forward rotation. As shown in FIGS. 2 and 8, the rotation direction converting mechanism 90 hereby functions to transfer the driving force from the motor 71 to the returning roller 62 so as to always rotate the returning roller 62 in a certain direction regardless of the rotation direction of the motor 71.

Operation of Driving Mechanism when Double Side Printing

Next, the operation of the driving mechanism 70 at the time of double-sided printing will be described.

Figure 9A:
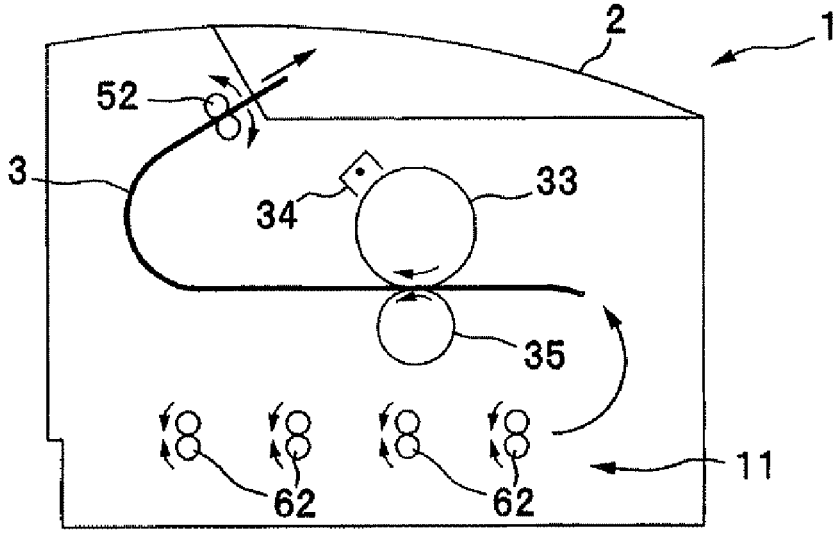
FIG. 9A is a diagram showing a state when the surface of the paper is printed.

As shown in FIG. 9A, when the command of the double-sided printing is input to the laser printer 1, the motor 71 which is controlled by a control device (not shown) forwardly rotates, and the photosensitive drum 33, the discharging roller 52 and each returning roller 62 or the like forwardly rotate. The surfaces of the papers 3 in the paper feeding tray 11 hereby are printed with the photosensitive drum 33 and the papers 3 are discharged outside of the apparatus main body 2 by the discharging roller 52.

Figure 9B:
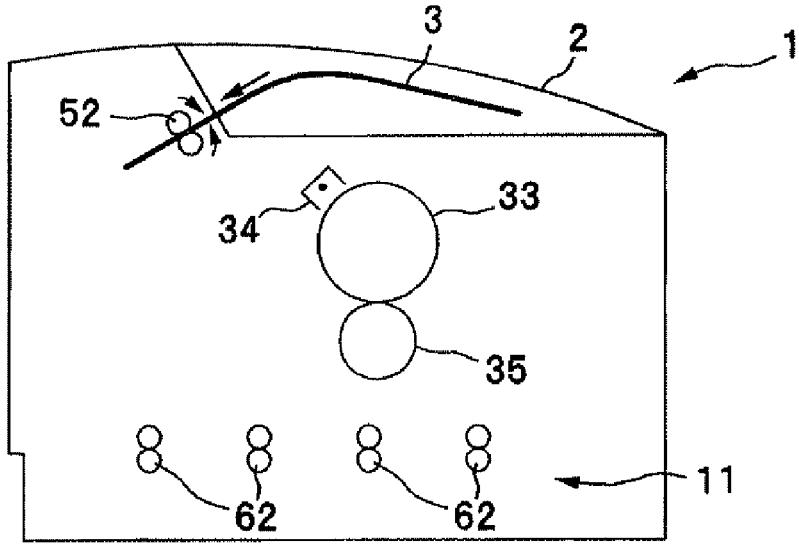
FIG. 9B is a diagram showing a state when the paper is returned by means of a reverse rotation of a discharging roller.

Thereafter, before the papers 3 are completely removed from the discharging roller 52, motor 71 rotates reversely, so that, as shown in FIG. 9B, the discharging roller 52 rotates reversely and the papers 3 are returned into the apparatus main body 2. At this time, as shown in FIG. 8, due to the action of a one-way clutch 72, the driving force of the reversely rotating motor 71 is not transferred to the photosensitive drum 33, so that the photosensitive drum 33 is stopped as shown in FIG. 9B. Furthermore, while the time until all of each member of the time lag mechanism 80 is engaged with each other and the time until the planetary gear 94 of the rotation direction converting mechanism 90 revolves to the rotation direction converting gear 92 have not passed, the returning roller 62 is also maintained at the stopped state.

Figure 9C:
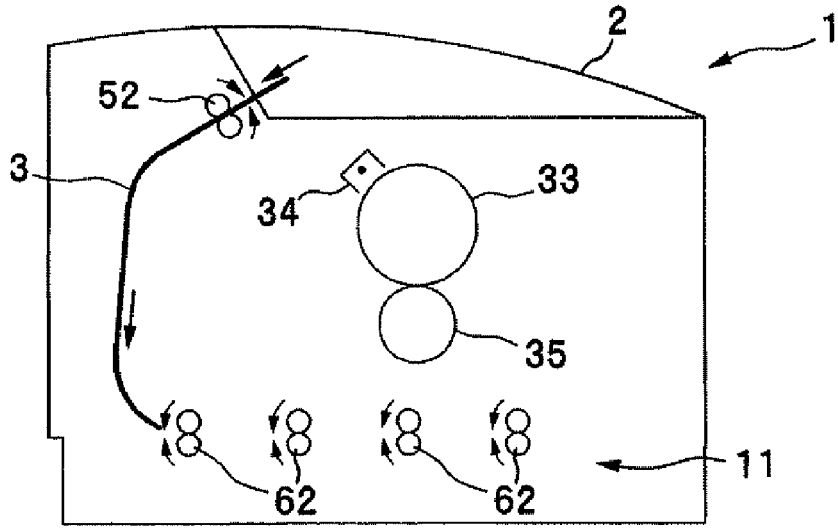
FIG. 9C is a diagram showing a state when the returned paper reaches a returning roller.

In addition, as shown in FIG. 8, when each member of the time lag mechanism 80 is engaged with each other and at the same time the planetary gear 94 of the rotation direction converting mechanism 90 reaches the rotation direction converting gear 92 and they are engaged with each other, the driving force of the motor 71 is transferred to the returning roller 62. Thus, the returning roller 62 rotates forwardly as shown in FIG. 9C. In addition, as shown in FIG. 9C, it is preferable that the timing of the returning of the forward rotation of the returning roller 62 should be before the front ends (front ends in the progress direction) of the papers 3, which have been returned into the apparatus main body 2 by the discharging roller 52, reach an initial (the most upstream side) returning roller 62. As a result, the time lag mechanism 80 and the rotation direction converting mechanism 90 may be configured such that the forward rotation of the returning roller 62 is returned at this timing.

Figure 10A:
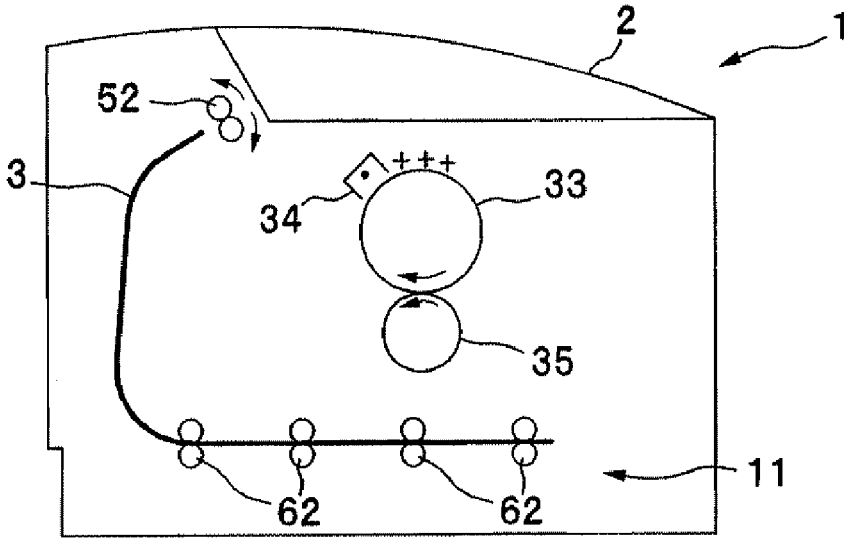
FIG. 10A is a diagram showing a state when the rear end of the paper is discharged from the discharging roller.

Thereafter, as shown in FIG. 10A, the papers 3 are transported so as to be returned to the upstream side of the photosensitive drum 33 by each returning roller 62, and when the rear ends (rear ends in the progressing direction) of the papers 3 are removed from the discharging roller 52, the motor 71 can be switched from the reverse rotation to the forward rotation. Thus, until each member of the time lag mechanism 80 is engaged with each other and the planetary gear 94 of the rotation direction converting mechanism 90 revolves to the downstream side gear 91 and they are engaged with each other, each returning roller 62 is stopped again, and the transportation of the papers 3 is stopped.

Figure 10B:
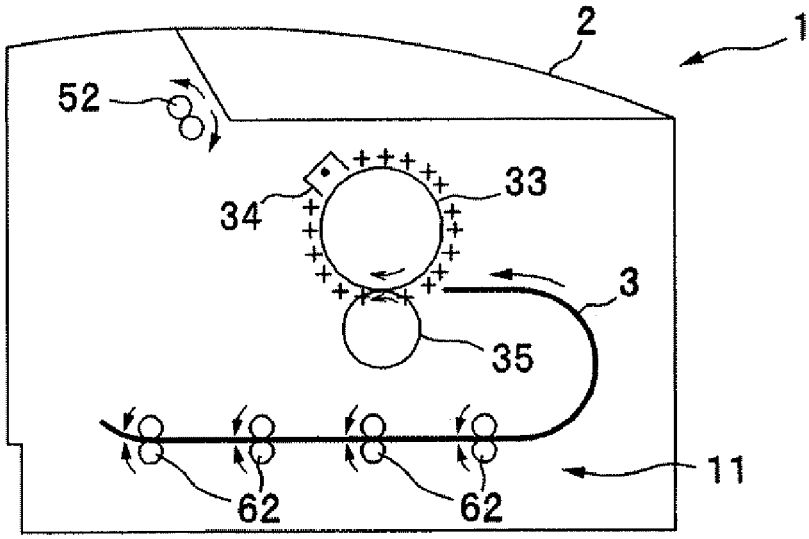
FIG. 10B is a diagram showing a state when the returning roller begins to rotate.

In addition, while the transportation of the paper 3 is stopped, the photosensitive drum 33 begins to forwardly rotate again by the action of the one-way clutch 72, and the charging is started by the scorotron-type charger 34. In addition, after the overall circumference of the photosensitive drum 33 is satisfactorily charged, as shown in FIG. 10B, the forward rotation of the returning roller 62 is returned and the transportation of the paper 3 is resumed. Thus, the back sides of the papers 3 are satisfactorily printed by means of the photosensitive drum 33 of a state in which the preparation of the image forming is satisfactorily performed.

Furthermore, while, in the present embodiment, it is configured so that after the overall circumference of the photosensitive drum 33 has been satisfactorily charged, the forward rotation of the returning roller 62 is returned, strictly, before the front end of the paper 3 reaches the photosensitive drum 33, the overall circumference of the photosensitive drum 33 may be satisfactorily charged. That is, even if before the overall circumference of the photosensitive drum 33 is satisfactorily charged, the forward rotation of the returning roller 62 is returned, before the front end of the paper 3 reaches the photosensitive drum 33, the overall circumference of the photosensitive drum 33 may be satisfactorily charged. In addition, the time lag mechanism 80 and the rotation direction converting mechanism 90 may be configured so that the papers 3 dash into the photosensitive drum 33 at this timing.

According to the above structure, the following effects can be obtained in the present embodiment.

After the motor 71 is switched from the reverse rotation to the forward rotation, the returning roller 62 can be stopped for a certain time. Thus, it is possible to prevent the paper 3 from reaching the photosensitive drum 33, before the overall circumference of the photosensitive drum 33 which begins to forwardly rotate is charged. As a result, even when the return path is short, it is possible to satisfactorily perform the double-sided printing.

Since the input gear 81 and the output gear 82 of the time lag mechanism 80 are arranged coaxially with each other, it is possible to facilitate the compactness as compared with the time lag mechanism which is not arranged coaxially.

Since the time lag member 83 is installed between the input gear 81 and the output gear 82, by adjusting the number of the time lag member 83, the time of the time lag can be simply adjusted. In addition, the time lag member 83 is arranged coaxially with the input gear 81 and the output gear 82, which can promote the compactness.

Since a plurality (two) of time lag members 83 is installed between the input gear 81 and the output gear 82, the time lag time can be extended.

Since the time lag member 83 is formed in a point symmetrical shape, the operator may install the first protrusion 83B and the second protrusion 83C even in a manner that the directions thereof are reversed. Thus, it is possible to facilitate the assembling operation.

Since there is adopted the rotation direction converting mechanism 90 that has the planetary gear 94 moving around the output gear 82, even when the planetary gear 94 moves around the output gear 82, it is possible to delay the time when the driving force is transferred to the returning roller 62. That is, the time lag can be made even in the rotation direction converting mechanism 90. Thus, it is possible to shorten the time delayed by the time lag mechanism 80 to that extent and simplify the structure of the time lag mechanism 80 (for example, the time lag member 83 can be reduced).

In addition, the present invention is not limited to the above-mentioned embodiment, but can be used in various embodiments described hereinafter.

In the above-described embodiment, while there is adopted the rotation direction converting mechanism 90 in which the planetary gear 94 revolves by half-circumference or more, the present embodiment is not limited thereto. For example, a rotation direction converting mechanism 100 as shown in FIG. 11A may be adopted.

Specifically, the rotation direction converting mechanism 100 includes an upstream side gear 110, a downstream side gear 120, and a V-shaped oscillating arm 130 that is oscillated about the rotation axis of the upstream side gear 110. At one end of the oscillating arm 130, a gear 140 moving around the upstream side gear 110 is rotatably installed, and at the other end of the oscillating arm 130, a gear 150 moving around the upstream side gear 110 and a gear 160 engaging with the gear 150 are rotatably installed.

Figure 11A:
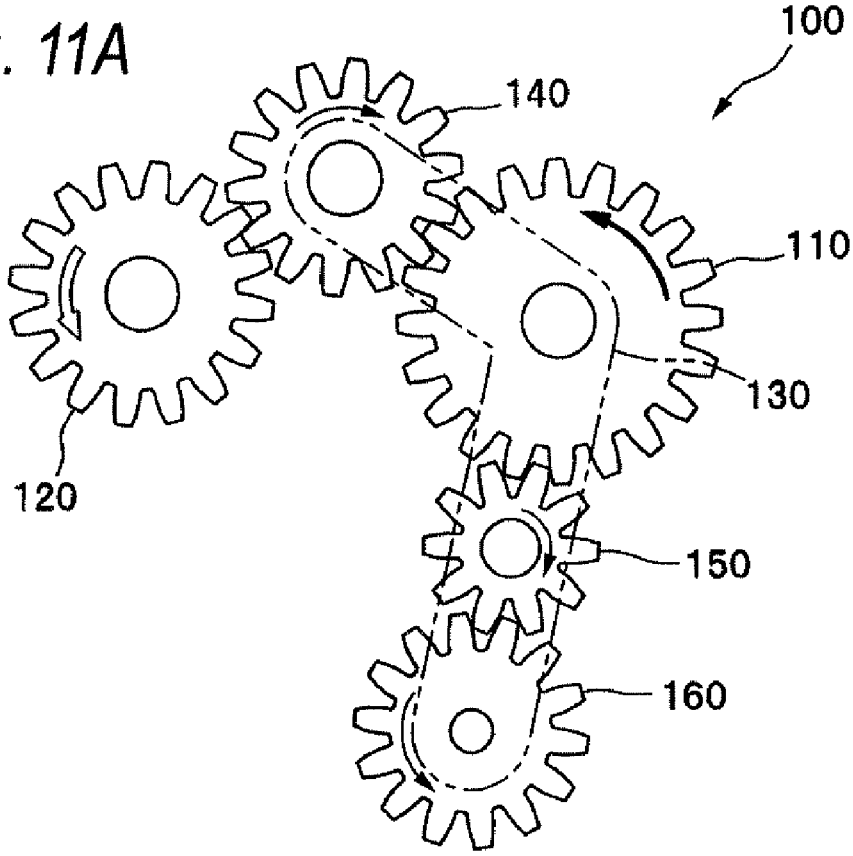
FIGS. 11A and 11B are plan views showing a modified example of the rotation direction converting mechanism.
Figure 11B:
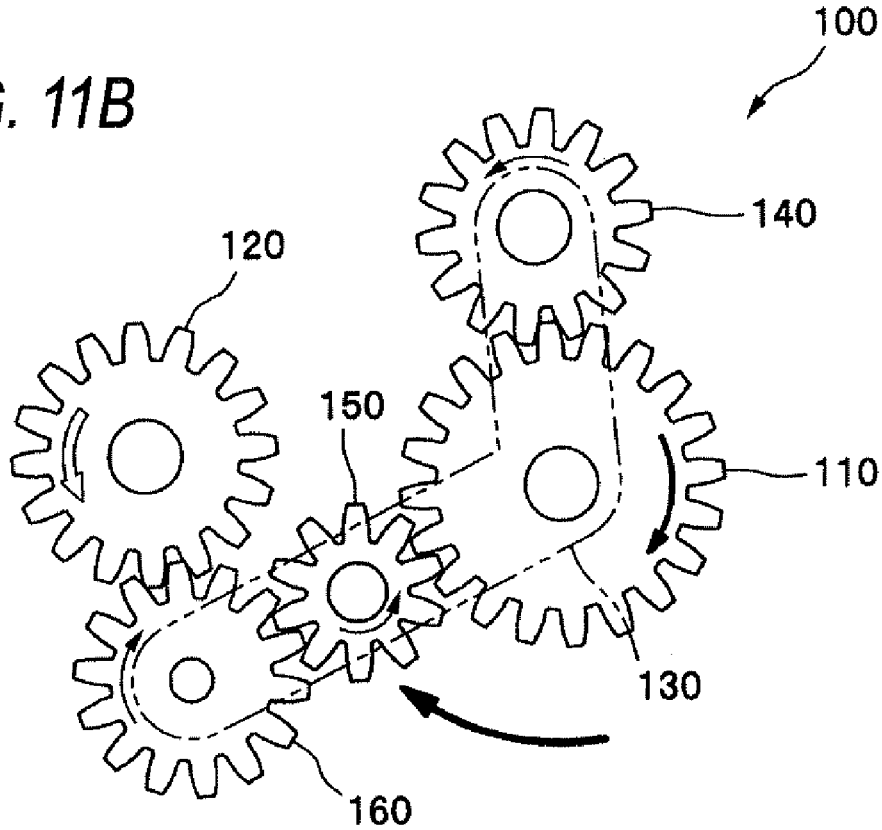

In addition, as shown in FIG. 11A, in the rotation direction converting mechanism 100, when the upstream side gear 110 rotates forwardly, the gear 140 at one end side of the oscillating arm 130 is engaged with the downstream side gear 120 so as to rotate the downstream side gear 120 in the counterclockwise direction as shown. Furthermore, when the upstream side gear 110 rotates reversely, as shown in FIG. 11B, the gear 160 at the other end side of the oscillating arm 130 is engaged with the downstream side gear 120 due to the oscillation of the oscillating arm 130, so as to rotate the downstream side gear 120 in the counterclockwise direction as shown. That is, even in the rotation direction converting mechanism 100, it is possible to always rotate the downstream side gear 120 and accordingly the returning roller in a certain direction.

Figure 12A:
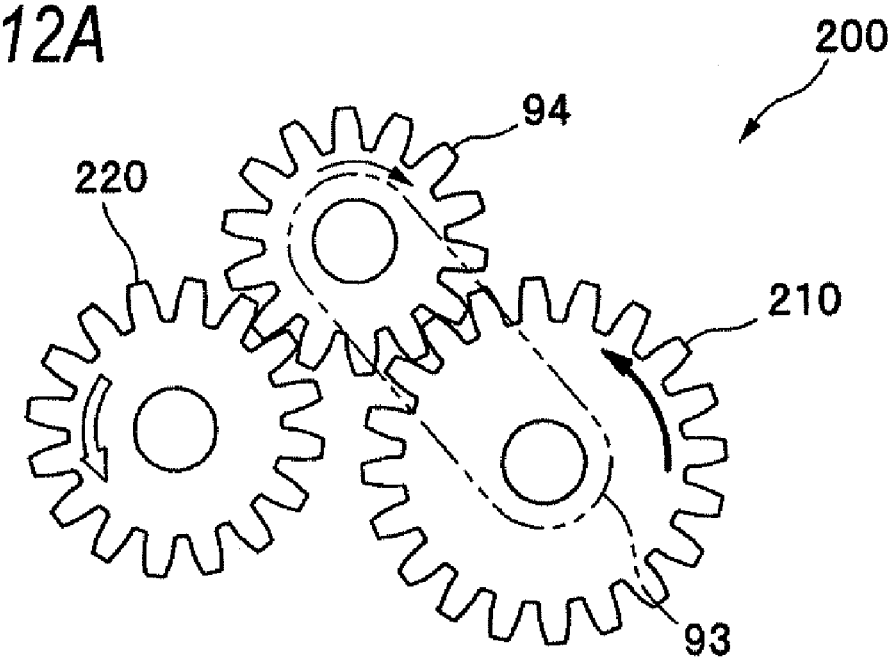
FIGS. 12A and 12B are plan views showing a modified example of the time lag mechanism.

While in the above-described embodiment, there is adopted the time lag mechanism 80 in which the input gear 81 and the output gear 82 are arranged coaxially with each other, the present invention is not limited thereto, for example, as shown in FIG. 12A, a time lag mechanism 200 in which an input gear 210 and an output gear 220 are not arranged coaxially with each other may be adopted. Specifically, the time lag mechanism 200 is constructed such that the rotation direction converting gear 92 is removed from the rotation direction converting mechanism 90 of the above-described embodiment. That is, the oscillating arm 93 and the planetary gear 94 identical to the above-described embodiment are installed so as to be able to oscillate and move with respect to the input gear 210.

Figure 12B:
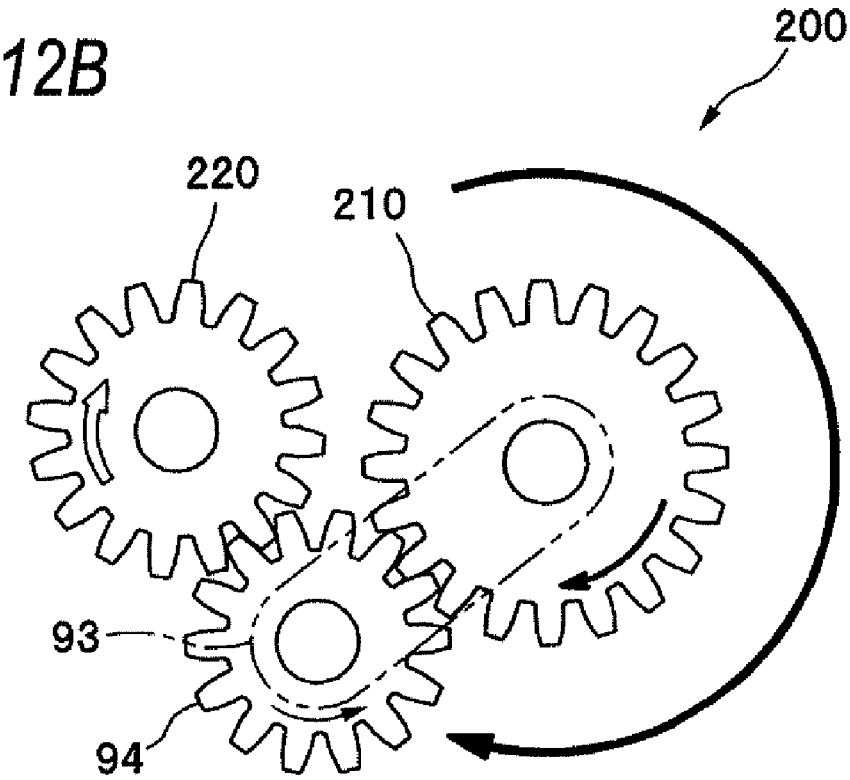

Even in the time lag mechanism 200, if it is switched from a forward rotation state shown in FIG. 12A to a reverse rotation state shown in FIG. 12B, the time lag can be made by the time when the planetary gear 94 revolves around the input gear 210. In addition, in this structure, one pair of engaging portion is constituted by the gear teeth of the output gear 220 and the gear teeth of the planetary gear 94.

While in the above-described embodiment, two lag members 83 have been installed, the present invention is not limited thereto, the number of the time lag member may be one and three or more.

While in the above-described embodiment, the present invention has been applied to the laser printer 1, the present invention is not limited thereto, but may be applied to other image forming apparatuses, e.g., a copier and a combination device or the like.

In the above-described embodiment, the photosensitive drum 33 has been adopted as the photosensitive drum, however the present invention is not limited thereto, for example, and a belt-shaped photoconductor may be adopted.

What is claimed is:

1. An image forming apparatus comprising:

an image forming unit that includes a photosensitive drum for carrying a developer image, the image forming unit configured to form an image on a recording sheet by transferring the developer image of the photosensitive drum onto the recording sheet;

a motor that is configured to rotate forwardly and reversely;

a discharging roller to which a driving force is transferred from the motor, the discharging roller configured to discharge the recording sheet outside of an apparatus main body when the motor rotates forwardly, the discharging roller configured to draw the recording sheet into the apparatus main body when the motor rotates reversely;

a one way clutch that transfers the driving force from the motor to the photosensitive drum when the motor rotates forwardly, the one way clutch blocking a transfer of the driving force from the motor to the photosensitive drum when the motor rotates reversely;

a returning roller that returns the recording sheet drawn by the discharging roller to the image forming unit;

a rotation direction converting mechanism that transmits the driving force from the motor to the returning roller so as to rotate the returning roller in a certain direction regardless of a rotation direction of the motor; and a time lag mechanism that includes a pair of engaging portions disposed with a gap therebetween, wherein, when the rotation direction of the motor is switched, each of the engaging portions engages with each other after a predetermined time, thereby delaying the transfer of the driving force from the motor to the returning roller.

2. The image forming apparatus according to claim 1, wherein the pair of engaging portions is disposed in a space between an input gear disposed at a position close to the motor and an output gear disposed at a position close to the returning roller.

3. The image forming apparatus according to claim 2, wherein the input gear is disposed coaxially with the output gear, and the pair of the engaging portions includes an input side protrusion and an output side protrusion, the input side protrusion protruding from the input gear toward the output gear, and the output side protrusion protruding from the output gear toward input gear and engaging with the input side protrusion in a circumferential direction of the output gear.

4. The image forming apparatus according to claim 3, wherein the time lag mechanism includes a time lag member that is disposed coaxially between the input gear and the output gear and is configured to be rotated, and the time lag member includes a first protrusion and a second protrusion, the first protrusion protruding toward the input gear and engaging with the input side protrusion in the circumferential direction, and the second protrusion protruding toward the output gear and engaging with the output side protrusion in the circumferential direction.

5. The image forming apparatus according to claim 4, wherein a plurality of the time lag members are provided between the input gear and the output gear.

6. The image forming apparatus according to claim 4, wherein the time lag member has a point symmetrical shape.

7. The image forming apparatus according to claim 1, wherein the rotation direction converting mechanism includes:

an upstream side gear that is disposed in a position close to the motor;

a downstream side gear that is disposed in a position close to the returning roller;

a rotation direction converting gear that engages with the downstream side gear; and a planetary gear that moves around the upstream side gear so as to engage with one of the downstream side gear and the rotation direction converting gear.

* * * * *